United States Patent [19]

Trumper et al.

[11] Patent Number: 4,515,410

[45] Date of Patent: May 7, 1985

[54] RACK ASSEMBLY

[75] Inventors: Thomas Trumper, Werne; Gunther-Dietmar Schoop, Ottmarsbocholt; Fritz Borgschulte; Friedrich Krummnack, both of Lünen, all of Fed. Rep. of Germany

[73] Assignee: Gewerkschaft Eisenhutte Westfalia, Lunen, Fed. Rep. of Germany

[21] Appl. No.: 522,801

[22] Filed: Aug. 12, 1983

[30] Foreign Application Priority Data

Aug. 14, 1982 [DE] Fed. Rep. of Germany ..... 3230382

[51] Int. Cl.[3] ..... E21C 35/20

[52] U.S. Cl. ..... 299/43; 105/29 R

[58] Field of Search ..... 299/45, 43, 42; 105/29 R

[56] References Cited

U.S. PATENT DOCUMENTS 4,082,361 4/1978 Lanfermann ..... 299/43
4,088,370 5/1978 Jarvis et al. ..... 299/43
4,155,600 5/1979 Lanfermann et al. ..... 299/43

FOREIGN PATENT DOCUMENTS 2646291 5/1976 Fed. Rep. of Germany ..... 299/43
2709111 3/1977 Fed. Rep. of Germany ..... 299/43

*Primary Examiner*—Stephen J. Novosad
*Assistant Examiner*—Michael A. Goodwin
*Attorney, Agent, or Firm*—Maurice E. Gauthier

[57] ABSTRACT

A rack assembly for a mine winning machine drive arrangement is described. The rack assembly is associated with a longwall conveyor along which a mine winning machine is movable by the drive arrangement. The rack assembly is constituted by a plurality of rack sections and a plurality of support members for connecting the rack sections to the longwall conveyor. Each of the rack sections has a respective downwardly-extending coupling pin at each end thereof, each of the coupling pins extending through an elongate slot in a respective support member with a predetermined amount of play. Each of the coupling pins is provided with a retaining member for preventing that coupling pin from moving out of the associated slot. The rack assembly is such that the rack sections of each adjacent pair of rack sections are relatively pivotable in vertical and horizontal directions, and are relatively movable to a predetermined extent in the longitudinal direction of the rack assembly.

22 Claims, 4 Drawing Figures

RACK ASSEMBLY

BACKGROUND TO THE INVENTION

This invention relates to a rack assembly for a mine winning machine drive arrangement, the rack assembly being associated with a longwall conveyor along which a mine winning machine is movable by the drive arrangement.

In order to move a mine winning machine (such as a shearer) to and fro along a longwall conveyor, it is known to mount a rack assembly having drive apertures on the conveyor, and to drive the machine along the rack assembly using a drive element which engages with the drive apertures. The rack assembly is constituted by a plurality of rack sections which are connected, by means of of horizontal bolts, to the channel sections of the longwall conveyor in such a manner as not to interfere with the necessary horizontal and vertical articulation movements of the channel sections. With a drive arrangement of this kind, it is difficult to avoid excessively great errors in the pitch of the drive apertures of the rack assembly at the regions where the rack sections adjoin each other, which errors are caused by the articulation movements of the channel sections. At the same time, however, the articulation movements of the channel sections should not be unnecessarily limited. As is well known, vertical articulation movements of the channel sections are necessary for adjusting the longwall conveyor to compensate for variations in the level of the floor of a mine working; whereas horizontal articulation movements of the channel sections are necessary to permit the conveyor to be advanced in sections, in what is known as a "snaking" advance movement. The articulation of the channel sections in the vertical plane is generally required to be greater than in the horizontal plane.

The rack sections may be arranged in such a way that they bridge the zones where the conveyor channel sections adjoin each other by a distance equal to half their length. This arrangement enables the articulation angle of the channel sections at the zones where the rack sections adjoin to be reduced, and thus leads to a reduction in the errors in the pitch of the drive apertures at these zones. In this system, the rack sections have a length which is either equal to, or less than, the length of each channel section. (See U.S. Pat. No. 4,082,361).

In a further development of the above-mentioned drive arrangement provision is made for permitting the rack sections to move longitudinally to a limited extent on the longwall conveyor with the aid of bolt-and-slot connections; and for using rack sections each having a convex face at one end and a complementary concave face at the other, so that the rack sections bear against each other at the end faces, and can move relatively to each other in the manner of a hinge. This arrangement is intended to ensure that, given adequate articulation of the channel sections in the vertical and horizontal planes (even when the longwall conveyor is moving along an arcuate path and undergoes vertical deflections), the minimum pitch dimension of the rack sections is not fallen short of to such extent that the drive element (a driven pinwheel) of the winning machine is unable to find a gap for the engagement of its teeth between the rack sections at the zones where the rack sections adjoin each other. (see DE-PS No. 2 646 291).

It is also known to attach the rack sections to the channel sections of the conveyor in an alternating sequence, wherein a first pair of rack sections are rigidly interconnected and the next pair have motional play in their longitudinal direction, and so on. This arrangement is aimed at eliminating, or reducing, the load on the support members for the rack sections, which load is caused by the articulation of the channel sections in the vertical and horizontal planes. (See DE-OS No. 2 721 867).

The aim of the invention is to provide a rack assembly having rack-attachment means that is particularly simple to construct and assemble and is at the same time stable; and to provide a rack assembly having individual rack sections which have great relative mobility to accommodate the required vertical and horizontal articulation of the channel sections, without the errors in pitch at the zones where the rack sections adjoin becoming undesirably great.

SUMMARY OF THE INVENTION

The present invention provides a rack assembly for a mine winning machine drive arrangement, the rack assembly being associated with a longwall conveyor along which a mine winning machine is movable by said drive arrangement, the rack assembly being constituted by a plurality of rack sections and a plurality of support members for connecting the rack sections to the longwall conveyor, wherein each of the rack sections has a respective downwardly-extending coupling pin at each end thereof, each of the coupling pins extending through an aperture in a respective support member with a predetermined amount of play, and each of the coupling pins being provided with a retaining member for preventing that coupling pin from moving out of the associated aperture, the rack assembly being such that the rack sections of each adjacent pair of rack sections are relatively pivotable in vertical and horizontal directions and are relatively movable to a predetermined extent in the longitudinal direction of the rack assembly.

Throughout this specification the terms "vertical" and "horizontal" should be construed as being at "right-angles to" and "parallel with" the floor of a mine working on which the conveyor carrying the rack assembly stands.

In this construction, the individual rack sections with their vertical coupling pins can be introduced from above into the apertures in the support members, and can be prevented from lifting by means of simple retaining members, this operation being easily and rapidly carried out even in constricted assembly areas. The strong coupling pins make it possible for the rack sections to be interconnected in a reliable manner; while at the same time, the greatest possible freedom of movement is achieved in accommodating the horizontal and vertical articulations of the channel sections of the associated longwall conveyor. In this arrangement, the coupling pins, because of the built-in play, are movable not only in the longitudinal direction of the rack, but can also turn about their vertical axes and about horizontal axes in the apertures in the support members.

In order to connect the rack sections, it is generally necessary only to provide holes for these pins in the support members. It is preferable, however, that the two coupling pins at the adjacent ends of each pair of adjacent rack sections pass through a respective common aperture in a respective support member. Advantageously, each of the apertures is an elongate slot formed in the associated support member, each of the slots having its major axis parallel to the longitudinal axis of the rack assembly, and each of the slots has arcuate end portions.

Preferably, each of the coupling pins is held within the associated aperture with a predetermined amount of play in both the longitudinal and vertical directions.

In a preferred embodiment, each of the rack sections is constituted by a pair of parallel strips which are rigidly interconnected by a plurality of drive pins. Advantageously, each of the coupling pins is provided with a base plate which is fixed to the lower surfaces of the parallel strips of the associated rack section, the lower surfaces of the base plates constituting abutment surfaces for bracing the rack sections against the support members. Thus, the rack sections are each braced against the support members at each of their ends, either directly, or indirectly by means of a base plate.

In a preferred embodiment, the adjacent end portions of each pair of adjacent rack sections are interconnected by tie members which limit the maximum distance between the end faces of the rack sections. This ensures that the errors in pitch affecting the rack assembly at the zones where the rack sections adjoin each other, cannot exceed a predetermined amount, thereby permitting effective engagement of the drive element and running of the winning machine, even when the greatest possible articulations of the channel sections occur. The tie members thus limit the plus errors in the pitch, that is to say the increase in the drive aperture pitch at the zones where the rack sections adjoin each other. The minus error in pitch (that is to say the amount by which the drive aperture pitch at the zones where the rack sections adjoin each other can be reduced) can be limited by abutment of the end faces of the rack sections, so that effective engagement of the drive element on the drive rack is ensured. For this purpose, one end face of each rack section is convex and the other end face of that rack section is concave, the concave and convex end faces of the rack sections being of complementary shape. Thus, errors in pitch at the zones where the rack sections adjoin are reliably limited to such an amount that said zones can be efficiently negotiated even in the case of relatively great vertical and horizontal articulations of the channel sections. Since all of the rack sections are longitudinally displacable to a limited extent relatively to the channel sections which carry them, the channel sections can also articulate through a relatively great angle, particularly in a vertical plane, without any undesirable transfer of force to the rack sections or to their support members.

Various elements can be used for the above-mentioned tie members, for example fishplates with holes for receiving the coupling pins, tie-bolts and the like. Preferably, however, each of the tie members is of chain link form, and each of the tie members is positioned around a respective pair of adjacent coupling pins which are associated with a respective common aperture, the tie members being positioned below the adjacent end portions of each pair of adjacent rack sections. Advantageously, each of the tie members surrounds the associated aperture in the associatd support member, the tie members being braced against the support members.

In a preferred embodiment, some of the tie members are rigidly connected to their associated support members, the remaining tie members being displaceably mounted on their support members. Conveniently, each of the tie members which is rigidly connected to its associated support member projects inwardly beyond the edge of the associated aperture in the associated support member. Preferably, every third tie member is rigidly connected to its associated support member.

Advantageously, each of the coupling pins has a reduced cross-section free end portion, the retaining members being positioned at the free ends of said reduced cross-section free end portions. Preferably, each of the retaining members is detachably mounted on the associated coupling pin.

The invention also provides a drive arrangement for driving a mine winning machine along a longwall conveyor, the drive arrangement comprising a rack assembly associated with the conveyor and a drive element associated with the winning machine, the drive element and the rack assembly being in drivable connection, wherein the rack assembly is as defined above.

The invention further provides a mineral mining installation comprising a longwall conveyor, a mine winning machine, and a mine winning machine drive arrangement, the drive arrangement being as defined above.

Advantageously, the conveyor is constituted by a plurality of channel sections joined end-to-end in such a manner as to permit limited articulation therebetween, and wherein each of the rack sections has a length which is at most substantially equal to half the length of each of the channel sections. Preferably, each rack section has a length which is substantially one third of the length of each of the channel sections.

BRIEF DESCRIPTION OF THE DRAWINGS

A mine winning machine drive arrangement incorporating a rack assembly constructed in accordance with the invention will now be described in detail, by way of example, with reference to the accompanying drawings, in which.

DESCRIPTION OF PREFERRED EMBODIMENT

Figure 1:
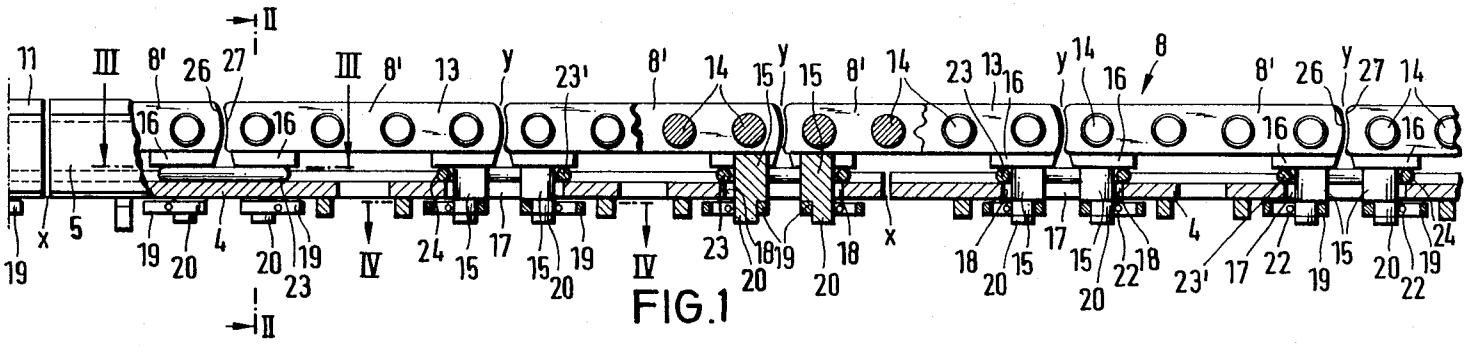
FIG. 1 is a part-sectional side elevation of the rack assembly.
Figure 2:
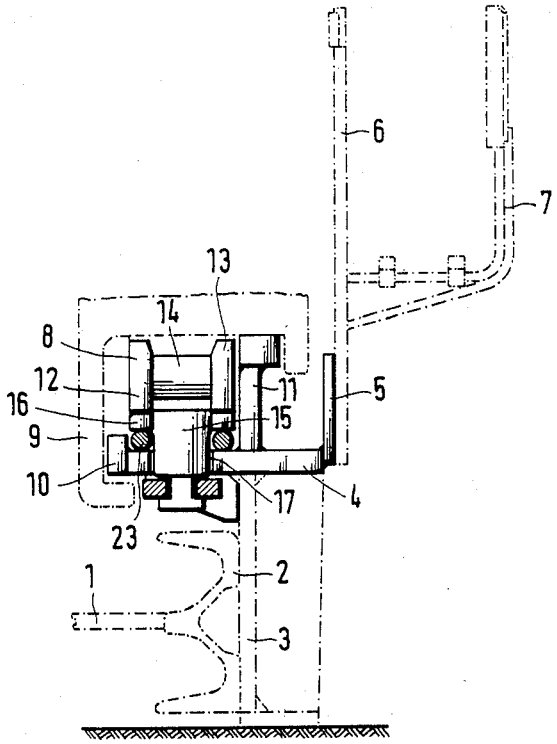
FIG. 2 is a part-sectional end elevation of the rack assembly, the section being taken on the line II—II of FIG. 1.

Referring to the drawings, FIG. 2 shows a longwall scraper-chain conveyor constituted by a plurality of channel sections (pans) 1 which are connected together end-to-end so as to resist tensile loads, but so as to permit limited articulation therebetween. The horizontal articulation is arranged to be approximately 3° to 4°, and the vertical articulation is arranged to be approximately 4° to 6°. The goaf-side side walls 2 of the channel sections 1 are provided with bolted-on spill plates 3. Each spill plate 3 carries a horizontal support member 4 which extends a predetermined distance beyond the associated side wall 2. The support members 4 extend along substantially the entire length of the channel sections 1. The zones at which the support members 4 adjoin each other coincide with the zones where the channel sections 1 of the longwall conveyor adjoin each other. These zones are indicated at X in FIG. 1.

Each support member 4 has a vertical limb 5, to which upstanding barrier plates 6 and 7 are connected, these barrier plates defining a cable duct. The support members 4 may also be constituted by angle sections which are fixed to the upper ends of the spill plates 3 in a permanent manner, for example, by welding, or releasably, for example by means of bolts.

The horizontal support members 4 carry a rack 8 having drive apertures which are engageable with a driven pinwheel (not shown) provided on an associated winning machine (such as a shearer) for advancing the winning machine. In use, the pinwheel engages in the drive apertures of the rack 8 to move the winning machine along the longwall conveyor when the winning work is being carried out. FIG. 2 shows schematically in dash-dot lines, the support arm 9 of the winning machine, this support arm being arranged to slide on guide bars 10 and 11. Each channel section 1 is provided with a pair of guide bars 10 and 11 which extend along substantially the entire length of that channel section. The guide bars 10 and 11 are arranged on opposite sides of the rack 8, and are secured to the support members 4 by, for example, welding. The guide bar 11 of each channel section 1 extends upwardly above the rack 8, and forms a lateral abutment surface for the rack. The other guide bar 10 of each channel section 1 is secured to the free end of the associated support member 4, and projects slightly beyond the upper face of that support member. The guide bars 10 also act as lateral abutment surfaces for the rack 8, or for the members attached thereto.

The rack 8 is constituted by a plurality of rack sections 8', the length of each of which is approximately one third of the length each of the channel sections 1, so that three rack sections are associated with each channel section. As shown in FIG. 1, the rack sections 8' are arranged to bridge the zones X at which the channel sections 1 adjoin each other. Alternatively, the rack sections 8' may be so disposed that the zones Y where every third pair of adjacent rack sections adjoin each other coincide with the zones X. Each rack section 8' is constituted by two parallel strips 12 and 13 rigidly interconnected, for example by welding, by four drive pins 14.

Each of the rack sections 8' has a respective downwardly-projecting coupling pin 15 at each end thereof. Each coupling pin 15 has a D-shaped cross-section (see FIG. 3). Each pin 15 is intergral with, or welded to, a base plate 16, the width of which corresponds to that of the rack 8. Each base plate 16 is fixed, for example by welding, to the lower faces of the strips 12 and 13 of the associated rack section 8'. The coupling pins 15 extend through elongate slots 17 in the support members 4, the longer axes of these slots being parallel to the longitudinal axis of the rack 8. The slots 17 have rounded end portions 18 which complement the rounded form of the D-shaped coupling pins 15. Thus, the coupling pins 15 bear, over a large area, against the rounded end portions 18. The slots 17 are of such shape and size that the two coupling pins 15 at the adjacent ends of two adjacent rack sections 8' can extend through a single slot.

The coupling pins 15 extend through the slots 17 with a predetermined amount of play both in the direction of the longitudinal axis of the rack 8, and in the vertical direction. During normal (rectilinear) travel of the winning machine along the longwall conveyor, without articulation of the channel sectons 1 in either the vertical or the horizontal plane, a predetermined amount of play in the direction of the axis of the rack 8 is present at the zones Y where the rack sections 8' adjoin each other, this amount of play being roughly double the magnitude of the longitudinal play of the coupling pins 15 in the slots 17. All of the rack sections 8' are, therefore, longitudinally displaceable, within the limits of said play, relatively to the channel sections 1 that carry them, or to their support members 4. Moreover, the rack sections 8' are also vertically displaceable to a slight extent. Pivotal movements, of a certain magnitude, about the vertical axes of the coupling pins 15, as well as pivotal movements about the axes at right-angles thereto, are also possible.

Figure 4:
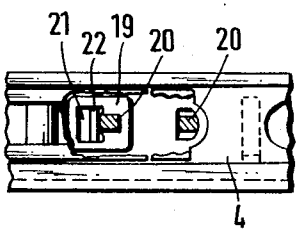
FIG. 4 is a cross-section taken on the line IV—IV of FIG. 1.

The rack sections 8' are prevented from lifting away from the support members 4 by providing each of the coupling pins 15 with a retaining member 19. Each coupling pin 15 has a reduced thickness, T-shaped end portion 20 at a region roughly corresponding to the level of the undersides of the associated support member 4, the end portions 20 projecting downwardly beyond these undersides. As shown in FIG. 4, the end portions 20 of the pins 15 are approximately rectangular in cross-section. Each of the retaining members 19 is an approximately rectangular locking plate which includes an aperture 21 of generally T-shaped configuration (see FIG. 4) where matches the shape of the associated pin end portion 20. The locking plates 19 are pushed, from below, over the end portions 20 of the pins 15 and are then moved in the longitudinal direction of the rack 8 so that the pin end portions move into the narrower portions of the T-shaped apertures 21. Then, a respective resilient cotter pin 22 is driven into aligned holes drilled in each locking plate 19 and the associated pin end portion 20, so that the cotter pins secure the locking plates to the pin end portions in a shape-locking manner, with the locking plates extending below the undersides of the support members 4, with a slight vertical clearance.

Instead of using locking plates, the retaining members 19 may be of any suitable known kind, provided they can be releasably attached to the pin end portions 20, and they can prevent the coupling pins from lifting out of the slots 17 in the support members 4, without preventing the coupling pins from moving in the slots.

Figure 3:
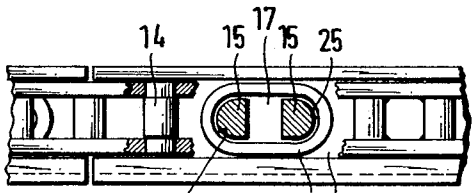
FIG. 3 is a cross-section taken on the line III—III of FIG. 1.

The adjacent ends of each pair of adjacent rack sections 8' are interconnected by tie members in the form of rings 23 or 23' (see FIGS. 1 to 3). The rings 23 and 23' are disposed below the ends of the rack sections 8', and two coupling pins 15 pass through each of the rings (see FIG. 3). The rings 23 and 23' surround the slots 17, and have oval openings which are slightly smaller than the slots.

Each of the rings 23' is disposed at the middle of a respective channel section 1, and is solidly connected, for example, by a welded joint 24 (see FIG. 1) to a respective support member 4 of that channel section in such a manner that it surrounds the associated slot 17 and, such that its arcuate inner faces project slightly beyond the peripheral surface of that slot and into that slot. In this way, each ring 23' forms a bearing and abutment surface for the rounded surfaces of the associated coupling pins 15.

The other rings 23 are displaceably mounted on the associated support members 4. Here again, the rings 23 have rounded surfaces 25 (see FIG. 3) which form bearing and abutment surfaces for the rounded surfaces of the associated coupling pins 15.

The rank sections 8' are braced on the rings 23 and 23' by means of the base plates 16. The underside of each base plate 16, therefore, forms an abutment surface which lies on the rounded faces of the rings 23 and 23'.

Each of the rack sections 8' has an outwardly-projecting arcuate end face 26 and, at it other end, a complementary concave end face 27. The rings 23 and 23' form tie members which limit the maximum distance between the adjacent end faces 26 and 27 of the rack sections 8' coupled by the ring concerned. Because of the surface contact of the end faces 26 and 27, the smallest possible error in pitch (minus error) occurs when the channel sections 1 (and therefore the rack sections 8') are articulated. The maximum error in pitch (plus error) at the zones Y where the rack sections 8' adjoin is determined by the abutment of the rounded surfaces 25 against the rounded inner surfaces of the rings 23 and 23'. This ensures that, at the zones Y, no errors in pitch occur that are of a magnitude that would interfere with the engagement of the pinwheel in the drive apertures or with smooth travel over the zones Y. The play of the rack sections 8', that is to say the play of their coupling pins 15 within the slots 17 in the support members 4, in conjunction with the longitudinal dimensions of the rack sections, permits the channel sections 1 to articulate horizontally and vertically through relatively large angles.

We claim:

1. A rack assembly for a mine winning machine drive arrangement, the rack assembly being associated with a longwall conveyor along which a mine winning machine is movable by said drive arrangement, the rack assembly comprising a plurality of rack sections and a plurality of support members for connecting the rack sections to the longwall conveyor, wherein each of the rack sections has a respective downwardly-extending coupling pin at each end thereof, each of the coupling pins extending through an aperture in a respective support member with a predetermined amount of play, and each of the coupling pins having a retaining member for preventing that coupling pin from moving out of the associated aperture, the rack sections of each adjacent pair of rack sections being relatively pivotable in vertical and horizontal directions and being relatively movable to a predetermined extent in the longitudinal direction of the rack assembly.

2. A rack assembly according to claim 1, wherein the two coupling pins at the adjacent ends of each pair of adjacent rack sections pass through a respective common aperture in a respective support member.

3. A rack assembly as claimed in claim 2, wherein each of the apertures is an elongate slot formed in the associated support member, each of the slots having its major axis parallel to the longitudinal axis of the rack assembly.

4. A rack assembly according to claim 3, wherein each of the slots has arcuate end portions.

5. A rack assembly according to claim 2, wherein each of the coupling pins is held within the associated aperture with a predetermined amount of play in both the horizontal and vertical directions.

6. A rack assembly according to claim 2, wherein each of the rack sections comprises a pair of parallel strips which are rigidly interconnected by a plurality of drive pins.

7. A rack assembly according to claim 6, wherein each of the coupling pins has a base plate which is fixed to the lower surfaces of the parallel strips of the associated rack section, the lower surfaces of the base plates constituting abutment surfaces for bracing the rack sections against the support members.

8. A rack assembly according to claim 2, wherein the adjacent end portions of each pair of adjacent rack sections are interconnected by tie members which limit the maximum distance between the end faces of the rack sections.

9. A rack assembly according to claim 8, wherein each of the tie members is of chain link form.

10. A rack assembly according to claim 9, wherein each of the tie members is positioned around a respective pair of adjacent coupling pins which are associated with a respective common aperture, the tie members being positioned below the adjacent end portions of each pair of adjacent rock sections.

11. A rack assembly according to claim 10, wherein each of the tie members surrounds the associated aperture in the associated support member, the tie members being braced against the support members.

12. A rack assembly according to claim 9, wherein some of the tie members are rigidly connected to their associated support members, the remaining tie members being displaceably mounted on their support members.

13. A rack assembly according to claim 12, wherein each of the tie members which is rigidly connected to its associated support member projects inwardly beyond the edge of the associated aperture in the associated support member.

14. A rack assembly according to claim 12, wherein every third tie member is rigidly connected to its associated support member.

15. A rack assembly according to claim 1, wherein each of the coupling pins has a reduced cross-section free end portion, the retaining members being positioned at the free ends of said reduced cross-section free end portions.

16. A rack assembly according to claim 1, wherein each of the retaining members is detachably mounted on the associated coupling pin.

17. A rack assembly according to claim 1, wherein said rack sections each have one end face which is convex and another end face which is concave, the concave and convex end faces of the rack sections being of complementary shape.

18. A drive arrangement for driving a mine winning machine along a longwall conveyor, the drive arrangement comprising a rack assembly associated with the conveyor and a drive element associated with the winning machine, the drive element and the rack assembly being in drivable connection, the rack assembly comprising a plurality of rack sections and a plurality of support members connecting the rack sections to the longwall conveyor, wherein each of the rack sections has a respective downwardly-extending coupling pin at each end thereof, each of the coupling pins extending through an aperture in a respective support member with a predetermined amount of play, and each of the coupling pins having a retaining member for preventing that coupling pin from moving out of the associated aperture, the rack sections of each adjacent pair of rack sections being relatively pivotable in vertical and horizontal directions and being relatively movable to a predetermined extent in the longitudinal direction of the rack assembly.

19. A mineral mining installation comprising a longwall conveyor, a mine winning machine, and a mine winning machine drive arrangement, the drive arrangement comprising a rack assembly associated with the conveyor and a drive element associated with the winning machine, the drive element and the rack assembly being in drivable connection, the rack assembly comprising a plurality of rack sections and a plurality of support members connecting the rack sections to the longwall conveyor, wherein each of the rack sections has a respective donwardly-extending coupling pin at each end thereof, each of the coupling pins extending through an aperture in a respective support member with a predetermined amount of play, and each of the coupling pins having a retaining member for preventing that coupling pin from moving out of the associated aperture, the rack sections of each adjacent pair of rack sections being relatively pivotable in vertical and horizontal directions and being relatively movable to a predetermined extent in the longitudinal direction of the rack assembly.

20. An installation according to claim 19, wherein the conveyor comprises a plurality of channel sections joined end-to-end in such a manner as to permit limited articulation therebetween, and wherein each of the rack sections has a length which is at most substantially equal to half the length of each of the channel sections.

21. An installation according to claim 20, wherein the two coupling pins at the adjacent ends of each pair of adjacent rack sections pass through a respective common aperture in a respective support member, wherein adjacent rack sections have adjacent end portions with end faces, said end portions being interconnected by tie members which limit the maximum distance between said end faces, each of the tie members being of chain link form, and wherein some of the tie members are rigidly connected to their associated support members, the remaining tie members being displaceably mounted on their support members.

22. An installation according to claim 21, wherein each rack section has a length which is substantially one third of the length of each of the channel sections, and wherein every third tie member is rigidly connected to its associated support member.

* * * * *